US009748631B2

(12) United States Patent
Etzkorn

(10) Patent No.: US 9,748,631 B2
(45) Date of Patent: Aug. 29, 2017

(54) MANUFACTURING METHOD FOR WIRELESS DEVICES

(71) Applicant: Verily Life Sciences LLC, Mountain View, CA (US)

(72) Inventor: James Etzkorn, Mountain View, CA (US)

(73) Assignee: Verily Life Sciences LLC, Mountain View, CA (US)

( * ) Notice: Subject to any disclaimer, the term of this patent is extended or adjusted under 35 U.S.C. 154(b) by 233 days.

(21) Appl. No.: 14/324,119

(22) Filed: Jul. 4, 2014

(65) Prior Publication Data

US 2016/0006115 A1 Jan. 7, 2016

(51) Int. Cl.

| | |
|---|---|
| ***H01Q 1/27*** | (2006.01) |
| ***H01Q 7/00*** | (2006.01) |
| ***H01Q 1/22*** | (2006.01) |
| ***H01Q 1/44*** | (2006.01) |

(52) U.S. Cl.

CPC ..... *H01Q 1/2225* (2013.01); *H01Q 1/273* (2013.01); *H01Q 1/44* (2013.01); *H01Q 7/00* (2013.01)

(58) Field of Classification Search

CPC ..... H01Q 1/22; H01Q 1/2208; H01Q 1/2283; H01Q 1/273; H01Q 1/3233; H01Q 1/38; H01Q 1/40; H01Q 1/405; H01Q 7/00; H01Q 7/005; H01Q 7/04; H01Q 7/06; H01Q 7/08

USPC ..... 343/728, 732, 741, 743, 744, 748, 788, 343/842, 855, 866

See application file for complete search history.

(56) References Cited

U.S. PATENT DOCUMENTS

| | | | | |
|---|---|---|---|---|
| 6,312,393 | B1 * | 11/2001 | Abreu | A61B 3/1241 600/558 |
| 6,885,818 | B2 * | 4/2005 | Goldstein | G03B 17/00 351/159.03 |
| 7,545,276 | B2 * | 6/2009 | Shionoiri | H01Q 1/2225 257/499 |

(Continued)

FOREIGN PATENT DOCUMENTS

WO WO 2012/136529 A1 10/2012

OTHER PUBLICATIONS

Almeida et al, The ARRL Antenna Book, 1988, The American Radio Relay League, 15th ed, pp. 2-24 to 2-25.*

(Continued)

*Primary Examiner* — Tho G Phan
*Assistant Examiner* — Patrick Holecek
(74) *Attorney, Agent, or Firm* — McDonnell Boehnen Hulbert & Berghoff LLP

(57) ABSTRACT

A manufacturing method for a wireless device may involve placing a plurality of antennas on a plastic layer, wherein each of the antennas comprises one or more conductive loops positioned within an inner diameter and an outer diameter; placing a plurality of sensor chips on the plastic layer such that each sensor chip is interconnected to a respective antenna on the plastic layer and is positioned within the inner diameter and outer diameter of the respective antenna, wherein each sensor chip has a respective sensor facing away from the plastic layer and has respective electrical contacts interconnected with the respective antenna; and providing an encapsulation layer over the plurality of antennas and the plurality of sensor chips on the plastic layer.

20 Claims, 13 Drawing Sheets

(56) References Cited

U.S. PATENT DOCUMENTS

| | | | | |
|---|---|---|---|---|
| 7,546,671 | B2 * | 6/2009 | Finn | G06K 19/07327 29/592.1 |
| 8,177,137 | B2 * | 5/2012 | Arai | H01Q 1/2208 235/375 |
| 2001/0014377 | A1 * | 8/2001 | Babb | B60C 23/0493 428/40.1 |
| 2006/0009251 | A1 | 1/2006 | Noda et al. | |
| 2006/0055531 | A1 | 3/2006 | Cook et al. | |
| 2007/0056683 | A1 * | 3/2007 | Manes | G06K 19/077 156/264 |
| 2007/0240304 | A1 * | 10/2007 | Eisenhardt | G06K 19/07718 29/825 |
| 2008/0265376 | A1 | 10/2008 | Tsurume et al. | |
| 2009/0076367 | A1 * | 3/2009 | Sit | A61B 3/16 600/398 |
| 2010/0234717 | A1 * | 9/2010 | Wismer | A61B 3/16 600/398 |
| 2012/0218508 | A1 * | 8/2012 | Pugh | B29D 11/00028 351/159.01 |
| 2013/0162405 | A1 | 6/2013 | Forster | |

OTHER PUBLICATIONS

International Search Report corresponding to co-pending International Application No. PCT/US2015/029220, Korean International Property Office, dated Jul. 30, 2015.

Written Opinion corresponding to co-pending International Application No. PCT/US2015/029220, Korean International Property Office, dated Jul. 30, 2015.

* cited by examiner

MANUFACTURING METHOD FOR WIRELESS DEVICES

BACKGROUND

Unless otherwise indicated herein, the materials described in this section are not prior art to the claims in this application and are not admitted to be prior art by inclusion in this section.

Wireless devices are used for many industrial and environmental applications. Wireless devices may include sensors that measure pressure, temperature, torque, humidity, chemical concentrations, etc. from various media such as liquid, vapor, and gas. Such wireless devices may have antennas configured to transmit sensor information to other devices.

SUMMARY

The present disclosure describes embodiments that relate to a manufacturing method for wireless devices. In one aspect, the present application describes a method. The method includes placing a plurality of antennas on a plastic layer, wherein each of the antennas comprises one or more conductive loops positioned within an inner diameter and an outer diameter. The method also includes placing a plurality of sensor chips on the plastic layer such that each sensor chip is interconnected to a respective antenna on the plastic layer and is positioned within the inner diameter and outer diameter of the respective antenna. Each sensor chip has a respective sensor facing away from the plastic layer and has respective electrical contacts interconnected with the respective antenna. The method further includes providing an encapsulation layer over the plurality of antennas and the plurality of sensor chips on the plastic layer.

In another aspect, the present disclosure describes a package. The package includes a plastic layer. The package also includes a plurality of antennas placed on the plastic layer, where each of the antennas comprises one or more conductive loops positioned within an inner diameter and an outer diameter. The package further includes a plurality of sensor chips placed on the plastic layer such that each sensor chip is interconnected to a respective antenna on the plastic layer and is positioned within the inner diameter and outer diameter of the respective antenna. Each sensor chip has a respective sensor facing away from the plastic layer and has respective electrical contacts interconnected with the respective antenna. The package also includes an encapsulation layer provided over the plurality of antennas and the plurality of sensor chips on the plastic layer.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1:
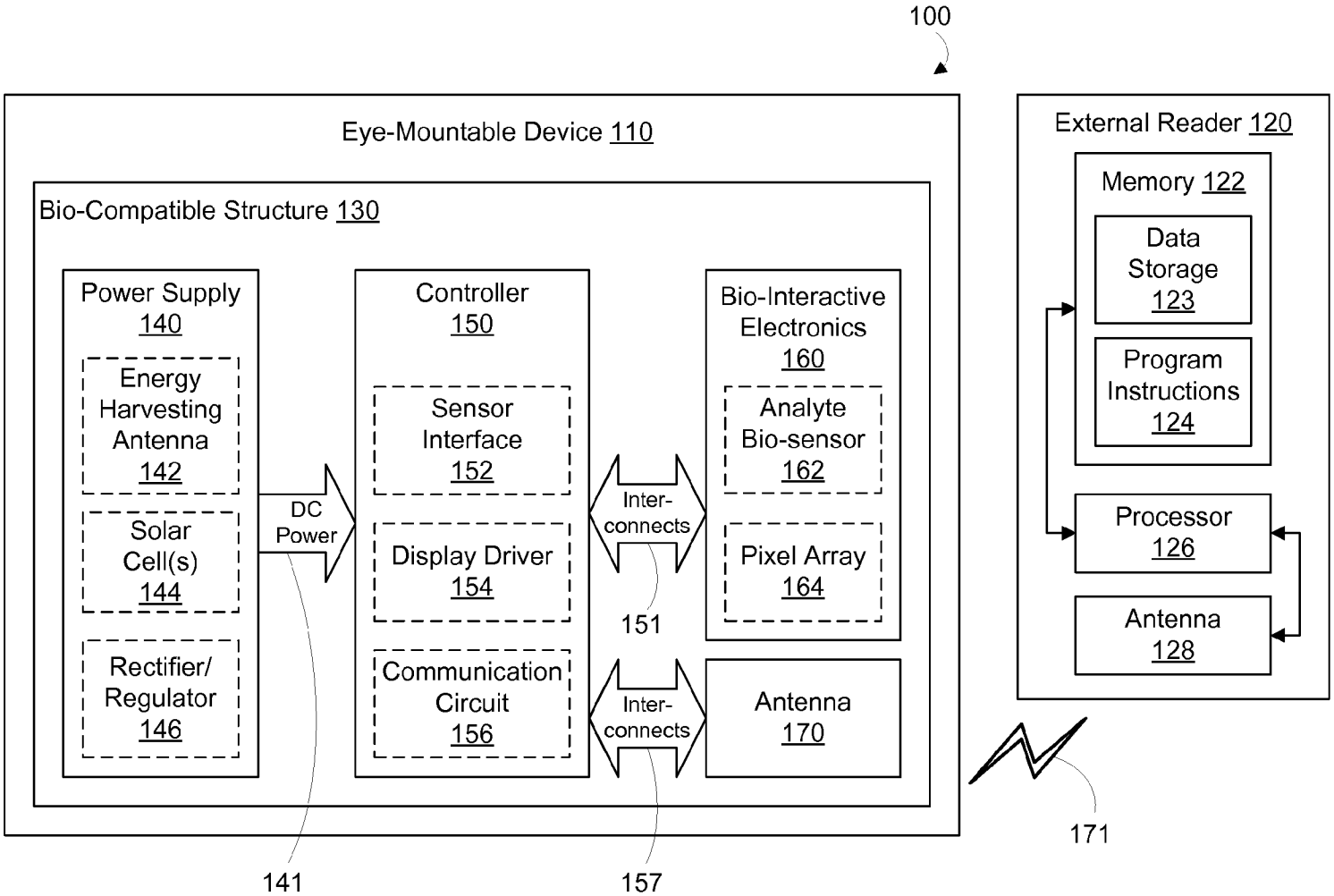
FIG. 1 is a block diagram of a system with an eye-mountable device in wireless communication with an external reader, in accordance with an example embodiment.

The following detailed description describes various features and functions of the disclosed systems and methods with reference to the accompanying figures. In the figures, similar symbols identify similar components, unless context dictates otherwise. The illustrative system and method embodiments described herein are not meant to be limiting. It may be readily understood that certain aspects of the disclosed systems and methods can be arranged and combined in a wide variety of different configurations, all of which are contemplated herein.

I. OVERVIEW

Example embodiments relate to a wireless device that includes, for example, a sensor, an antenna, an application specific integrated circuit (ASIC), a battery, an LED, etc. Semiconductor manufacturing techniques can be used to make such a device, but there are limitations in reducing the cost when the device includes an antenna to be fabricated on the same substrate as other components (sensors, ASIC, battery, LED, etc.).

One way to reduce cost of making such an electromechanical device is to implement roll-to-roll manufacturing. To implement roll-to-roll manufacturing, an array of wireless electromechanical devices may be provided on large rolls of plastic substrate (polyester, PET, polyimide, etc.). Each wireless electromechanical device may include an antenna and associated components or chips (e.g., sensors, ASICs, a battery, an LED, solar cells, etc.). The chips (e.g., sensors, ASICs, a battery, an LED, solar cells, etc.) could then be assembled to the antenna and the plastic substrate using, for example, flip-chip bonding or pick-and-place robots. Electrical connection between the chips and the antenna/substrate may be made using, for example, solder, anisotropic paste, or electroplating.

Each chip could be made on its own substrate and then assembled to the antenna and plastic substrate. Manufacturing such chips or components (e.g., flexible batteries and solar cells) may involve high temperature processing. Each chip can be made on its own substrate (e.g., silicon or glass), thinned down and diced in order to be bonded on a flexible substrate, and assembled to the antenna and plastic substrate, such that high temperature processing used in manufacturing the chip occurs before being assembled to the plastic substrate. The plastic substrate is thus not subjected to high temperatures. In this manner, this method represents a modular manufacturing process where a wide variety of components can be manufactured separately and assembled onto a single substrate at a reduced cost.

II. EXAMPLE SYSTEMS AND DEVICES

In some examples, the wireless device may be a body-mountable device or may be incorporated into a body-mountable device. The body-mountable device could be any device configured to be mounted an external body surface. For example, the body-mountable device could be an eye-mountable device configured to be mounted on an eye (e.g., on the cornea), a skin-mountable device configured to be mounted on a wrist, arm, leg, chest, neck, abdomen, or other skin location, or an orally-mountable device configured to be mounted on a tooth or other location within the mouth. In other examples, the wireless device may be used for industrial or environmental sensing and communication, or for other purposes.

FIG. 1 is a block diagram of a system 100 that includes an eye-mountable device 110 in wireless communication with an external reader 120. The eye-mountable device 110 may be a polymeric material that may be appropriately shaped for mounting to a corneal surface and in which a structure 130 is at least partially embedded. The structure 130 may include a power supply 140, a controller 150, bio-interactive electronics 160, and an antenna 170.

In some examples, the structure 130 may be a bio-compatible structure in which some or all of the components formed or mounted thereon are encapsulated by a bio-compatible material.

In some examples, the structure 130 may be positioned away from the center of the eye-mountable device 110 and thereby avoid interference with light transmission to the central, light-sensitive region of the eye. For example, where the eye-mountable device 110 is shaped as a curved disk, the structure 130 may be a ring-shaped structure embedded around the periphery (e.g., near the outer circumference) of the disk. In other examples, the structure 130 may be positioned in or near the central region of the eye-mountable device 110. For example, portions of the structure 130 may be substantially transparent to incoming visible light to mitigate interference with light transmission to the eye. Moreover, in some examples, the bio-interactive electronics 160 may include a pixel array 164 that emits and/or transmits light to be received by the eye according to display instructions. Thus, the bio-interactive electronics 160 may optionally be positioned in the center of the eye-mountable device so as to generate visual cues perceivable to a wearer of the eye-mountable device 110, such as displaying information (e.g., characters, symbols, flashing patterns, etc.) on the pixel array 164.

The power supply 140 is configured to harvest ambient energy to power the controller 150 and bio-interactive electronics 160, and may include an energy harvesting antenna 142 and/or solar cells 144. The energy harvesting antenna 142 may capture energy from incident radio radiation. The solar cells 144 may comprise photovoltaic cells configured to capture energy from incoming ultraviolet, visible, and/or infrared radiation.

A rectifier/regulator 146 may be used to condition the captured energy to a stable DC supply voltage 141 at a level suitable for operating the controller, and then supply the voltage to the controller 150. The rectifier/regulator 146 may include one or more energy storage devices to mitigate high frequency variations in the energy harvesting antenna 142 and/or solar cell(s) 144. For example, one or more energy storage devices (e.g., a capacitor or an inductor) may be connected in parallel across the outputs of the rectifier/regulator 146 to regulate the DC supply voltage 141 and may be configured to function as a low-pass filter.

The controller 150 is configured to execute instructions to operate the bio-interactive electronics 160 and the antenna 170. The controller 150 includes logic circuitry configured to operate the bio-interactive electronics 160 so as to interact with a biological environment of the eye-mountable device 110. The interaction could involve the use of one or more components, such an analyte bio-sensor 162 in the bio-interactive electronics 160, to obtain input from the biological environment. Additionally or alternatively, the interaction could involve the use of one or more components, such as a pixel array 164, to provide an output to the biological environment.

In one example, the controller 150 includes a sensor interface module 152 that is configured to operate the analyte bio-sensor 162. The analyte bio-sensor 162 may be, for example, an amperometric electrochemical sensor that includes a working electrode and a reference electrode driven by a sensor interface. A voltage is applied between the working and reference electrodes to cause an analyte to undergo an electrochemical reaction (e.g., a reduction and/or oxidation reaction) at the working electrode. The electrochemical reaction generates an amperometric current that can be measured through the working electrode. The amperometric current can be dependent on the analyte concentration. Thus, the amount of the amperometric current that is measured through the working electrode can provide an indication of analyte concentration. In some examples, the sensor interface module 152 can be a potentiostat configured to apply a voltage difference between working and reference electrodes while measuring a current through the working electrode.

In some instances, a reagent may also be included to sensitize the electrochemical sensor to one or more desired analytes. For example, a layer of glucose oxidase ("GOD") proximal to the working electrode can catalyze glucose oxidation to generate hydrogen peroxide ($H_2O_2$). The hydrogen peroxide can then be electro-oxidized at the working electrode, which releases electrons to the working electrode, resulting in an amperometric current that can be measured through the working electrode.

$$\text{glucose} + O_2 \xrightarrow{\text{GOD}} H_2O_2 + \text{gluconolactone}$$

$$H_2O_2 \longrightarrow 2\,H^+ + O_2 + 2\,e^-$$

The current generated by either reduction or oxidation reactions is approximately proportionate to the reaction rate. Further, the reaction rate is dependent on the rate of analyte molecules reaching the electrochemical sensor electrodes to fuel the reduction or oxidation reactions, either directly or catalytically through a reagent. In a steady state, where analyte molecules diffuse to the electrochemical sensor electrodes from a sampled region at approximately the same rate that additional analyte molecules diffuse to the sampled region from surrounding regions, the reaction rate is approximately proportionate to the concentration of the analyte molecules. The current measured through the working electrode thus provides an indication of the analyte concentration.

The controller 150 may also include a display driver module 154 for operating a pixel array 164. The pixel array 164 is an array of separately programmable light transmitting, light reflecting, and/or light emitting pixels arranged in rows and columns. The individual pixel circuits can optionally include liquid crystal technologies, microelectromechanical technologies, emissive diode technologies, etc. to selectively transmit, reflect, and/or emit light according to information from the display driver module 154. Such a pixel array 164 may also include more than one color of pixels (e.g., red, green, and blue pixels) to render visual content in color. The display driver module 154 can include, for example, one or more data lines providing programming information to the separately programmed pixels in the pixel array 164 and one or more addressing lines for setting groups of pixels to receive such programming information. Such a pixel array 164 situated on the eye can also include one or more lenses to direct light from the pixel array to a focal plane perceivable by the eye.

The controller 150 may also include a communication circuit 156 for sending and/or receiving information via the antenna 170. The communication circuit 156 may include one or more oscillators, mixers, frequency injectors, or the like to modulate and/or demodulate information on a carrier frequency to be transmitted and/or received by the antenna 170. In some examples, the eye-mountable device 110 is configured to indicate an output from a bio-sensor by modulating an impedance of the antenna 170 in a manner that is perceivable by the external reader 120. For example, the communication circuit 156 can cause variations in the amplitude, phase, and/or frequency of backscatter radiation from the antenna 170, and such variations may then be detected by the reader 120.

The controller 150 is connected to the bio-interactive electronics 160 via interconnects 151. Similarly, the controller 150 is connected to the antenna 170 via interconnects 157. The interconnects 151, 157 may comprise a patterned conductive material (e.g., gold, platinum, palladium, titanium, copper, aluminum, silver, metals, any combinations of these, etc.).

It is noted that the block diagram shown in FIG. 1 is described in connection with functional modules for convenience in description. However, embodiments of the eye-mountable device 110 can be arranged with one or more of the functional modules ("sub-systems") implemented in a single chip, integrated circuit, and/or physical component.

Additionally or alternatively, the energy harvesting antenna 142 and the antenna 170 can be implemented in the same, dual-purpose antenna. For example, a loop antenna can both harvest incident radiation for power generation and communicate information via backscatter radiation.

The external reader 120 includes an antenna 128 (or group of more than one antennae) to send and receive wireless signals 171 to and from the eye-mountable device 110. The external reader 120 also includes a computing system with a processor 126 in communication with a memory 122. The memory 122 is a non-transitory computer-readable medium that can include, without limitation, magnetic disks, optical disks, organic memory, and/or any other volatile (e.g., RAM) or non-volatile (e.g., ROM) storage system readable by the processor 126. The memory 122 includes a data storage 123 to store indications of data, such as sensor readings (e.g., from the analyte bio-sensor 162), program settings (e.g., to adjust behavior of the eye-mountable device 110 and/or external reader 120), etc. The memory 122 also includes program instructions 124 for execution by the processor 126. For example, the program instructions 124 may cause the external reader 120 to provide a user interface that allows for retrieving information communicated from the eye-mountable device 110 (e.g., sensor outputs from the analyte bio-sensor 162). The external reader 120 may also include one or more hardware components for operating the antenna 128 to send and receive the wireless signals 171 to and from the eye-mountable device 110. For example, oscillators, frequency injectors, encoders, decoders, amplifiers, and filters can drive the antenna 128 according to instructions from the processor 126.

The external reader 120 may be a smart phone, digital assistant, or other portable computing device with wireless connectivity sufficient to provide the wireless communication link 171. The external reader 120 may also be implemented as an antenna module that can be plugged in to a portable computing device, such as in an example where the communication link 171 operates at carrier frequencies not commonly employed in portable computing devices. In some instances, the external reader 120 is a special-purpose device configured to be worn relatively near a wearer's eye to allow the wireless communication link 171 to operate using little or low power. For example, the external reader 120 can be integrated in a piece of jewelry such as a necklace, earring, etc. or integrated in an article of clothing worn near the head, such as a hat, headband, etc.

In an example where the eye-mountable device 110 includes an analyte bio-sensor 162, the system 100 can be operated to monitor the analyte concentration in tear film on the surface of the eye. To perform a reading with the system 100 configured as a tear film analyte monitor, the external reader 120 can emit radio frequency radiation 171 that is harvested to power the eye-mountable device 110 via the power supply 140. Radio frequency electrical signals captured by the energy harvesting antenna 142 (and/or the antenna 170) are rectified and/or regulated in the rectifier/regulator 146 and a regulated DC supply voltage 141 is provided to the controller 150. The radio frequency radiation 171 thus turns on the electronic components within the eye-mountable device 110. Once turned on, the controller 150 operates the analyte bio-sensor 162 to measure an analyte concentration level. For example, the sensor interface module 152 can apply a voltage between a working electrode and a reference electrode in the analyte bio-sensor 162. The applied voltage can be sufficient to cause the analyte to undergo an electrochemical reaction at the working electrode and thereby generate an amperometric current that can be measured through the working electrode. The measured amperometric current can provide the sensor reading ("result") indicative of the analyte concentration. The controller 150 can operate the antenna 170 to communicate the sensor reading back to the external reader 120 (e.g., via the communication circuit 156).

In some examples, the system 100 can operate to non-continuously ("intermittently") supply energy to the eye-mountable device 110 to power the controller 150 and electronics 160. For example, radio frequency radiation 171 can be supplied to power the eye-mountable device 110 long enough to carry out a tear film analyte concentration measurement and communicate the results. For example, the supplied radio frequency radiation can provide sufficient power to apply a potential between a working electrode and a reference electrode sufficient to induce electrochemical reactions at the working electrode, measure the resulting amperometric current, and modulate the antenna impedance to adjust the backscatter radiation in a manner indicative of the measured amperometric current. In such an example, the supplied radio frequency radiation 171 can be considered an interrogation signal from the external reader 120 to the eye-mountable device 110 to request a measurement. By periodically interrogating the eye-mountable device 110 (e.g., by supplying radio frequency radiation 171 to temporarily turn the device on) and storing the sensor results (e.g., via the data storage 123), the external reader 120 can accumulate a set of analyte concentration measurements over time without continuously powering the eye-mountable device 110.

Figure 2A:
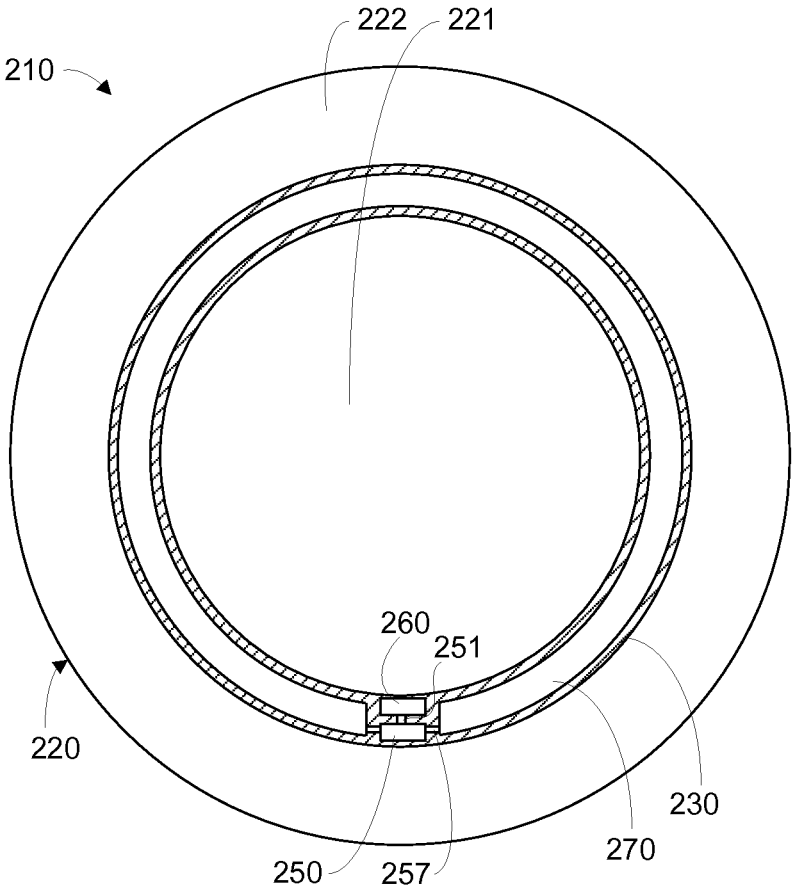
FIG. 2A is a top view of an eye-mountable device, in accordance with an example embodiment.
Figure 2B:
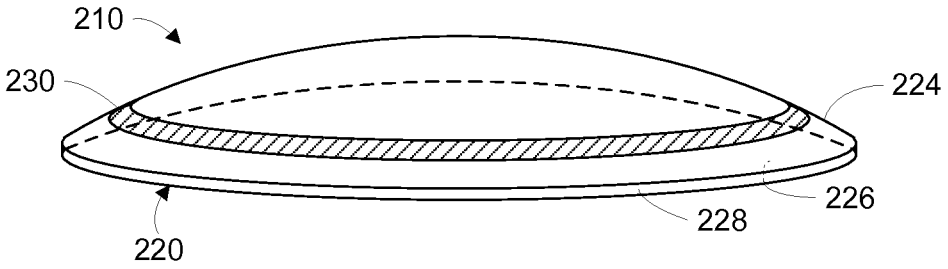
FIG. 2B is a side view of an eye-mountable device, in accordance with an example embodiment.

FIG. 2A is a top view of an eye-mountable device 210. FIG. 2B is side view of the eye-mountable device 210. It is noted that relative dimensions in FIGS. 2A and 2B are not necessarily to scale, but have been rendered for purposes of explanation only in describing the arrangement of the eye-mountable device 210.

The eye-mountable device 210 may include a polymeric material 220, which may be a substantially transparent material to allow incident light to be transmitted to the eye. The polymeric material 220 may include one or more bio-compatible materials similar to those employed to form vision correction and/or cosmetic contact lenses in optometry, such as polyethylene terephthalate ("PET"), polymethyl methacrylate ("PMMA"), polyhydroxyethylmethacrylate ("polyHEMA"), silicone hydrogels, or any combinations of these. Other polymeric materials may also be envisioned. The polymeric material 220 may include materials configured to moisturize the corneal surface, such as hydrogels and the like. In some examples, the polymeric material 220 is a deformable ("non-rigid") material to enhance wearer comfort.

To facilitate contact-mounting, the eye-mountable device 210 may comprise a concave surface 226 configured to adhere ("mount") to a moistened corneal surface (e.g., by capillary forces with a tear film coating the corneal surface). While mounted with the concave surface against the eye, a convex surface 224 of eye-mountable device 210 is formed so as not to interfere with eye-lid motion while the eye-mountable device 210 is mounted to the eye. A circular outer side edge 228 connects the convex surface 224 and the concave surface 226. The convex surface 224 can therefore be considered an outer, top surface of the eye-mountable device 210 whereas the concave surface 226 can be considered an inner, bottom surface. The "top" view shown in FIG. 2A is facing the convex surface 224.

The eye-mountable device 210 can have dimensions similar to a vision correction and/or cosmetic contact lenses, such as a diameter of approximately 1 centimeter, and a thickness of about 0.1 to about 0.5 millimeters. However, the diameter and thickness values are provided for explanatory purposes only. In some examples, the dimensions of the eye-mountable device 210 may be selected according to the size and/or shape of the corneal surface and/or the scleral surface of the wearer's eye. In some examples, the eye-mountable device 210 is shaped to provide a predetermined, vision-correcting optical power, such as provided by a prescription contact lens.

A structure 230 is embedded in the eye-mountable device 210. The structure 230 can be embedded to be situated near or along an outer periphery 222, away from a central region 221. Such a position ensures that the structure 230 will not interfere with a wearer's vision when the eye-mountable device 210 is mounted on a wearer's eye, because it is positioned away from the central region 221 where incident light is transmitted to the light-sensing portions of the eye. Moreover, portions of the structure 230 can be formed of a transparent material to further mitigate effects on visual perception.

The structure 230 may be shaped as a flat, circular ring (e.g., a disk with a centered hole). The flat surface of the structure 230 (e.g., along the radial width) allows for mounting electronics such as chips (e.g., via flip-chip mounting) and for patterning conductive materials to form electrodes, antenna(e), and/or interconnections. The structure 230 and the polymeric material 220 may be approximately cylindrically symmetric about a common central axis. The structure 230 may have, for example, a diameter of about 10 millimeters, a radial width of about 1 millimeter (e.g., an outer radius 1 millimeter greater than an inner radius), and a thickness of about 50 micrometers. These dimensions are provided for example purposes only, and in no way limit this disclosure.

A loop antenna 270, controller 250, and bio-interactive electronics 260 are included in the structure 230. The controller 250 may be a chip including logic elements configured to operate the bio-interactive electronics 260 and the loop antenna 270. The controller 250 is electrically connected to the loop antenna 270 by interconnects 257 also situated on the structure 230. Similarly, the controller 250 is electrically connected to the bio-interactive electronics 260 by an interconnect 251. The bio-interactive electronics 260 may include sensor electrodes, such as a working electrode and reference electrode, for electrochemical sensing. The interconnects 251, 257, the loop antenna 270, and any conductive electrodes (e.g., in the bio-interactive electronics) may be formed from any type of conductive material and may be patterned by any process that can be used for patterning such materials, such as deposition or photolithography, for example. The conductive materials patterned on the structure 230 may be, for example, gold, platinum, palladium, titanium, carbon, aluminum, copper, silver, silver-chloride, conductors formed from noble materials, metals, or any combinations of these materials. Other materials may also be envisioned.

The structure 230 may be a bio-compatible structure in which some or all of the components are encapsulated by a bio-compatible material. In one example, the controller 250, interconnects 251, 257, bio-interactive electronics 260, and the loop antenna 270 are fully encapsulated by bio-compatible material, except for the sensor electrodes in the bio-interactive electronics 260.

Figure 2D:
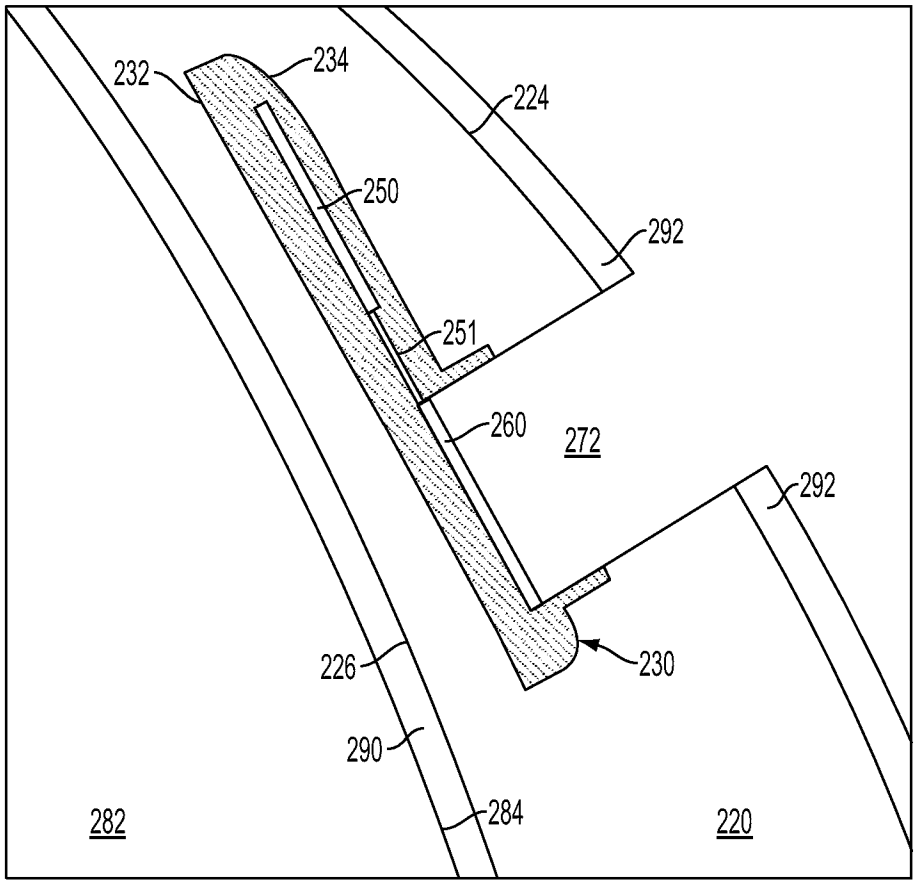
FIG. 2D is a side cross-section view showing the tear film layers surrounding the surfaces of the eye-mountable device mounted as shown in FIG. 2C, in accordance with an example embodiment.

As shown in FIG. 2A, the bio-interactive electronics module 260 is on a side of the structure 230 facing the convex surface 224. Where the bio-interactive electronics module 260 includes an analyte bio-sensor, for example, mounting such a bio-sensor on the structure 230 to be close to the convex surface 224 allows the bio-sensor to sense analyte that has diffused through convex surface 224 or has reached the bio-sensor through a channel in the convex surface 224 (FIGS. 2C and 2D show a channel 272).

The loop antenna 270 is a layer of conductive material patterned along the flat surface of the structure 230 to form a flat conductive ring. In some examples, the loop antenna 270 does not form a complete loop. For example, the loop antenna 270 may include a cutout to allow room for the controller 250 and bio-interactive electronics 260, as illustrated in FIG. 2A. However, in another example, the loop antenna 270 can be arranged as a continuous strip of conductive material that wraps entirely around the structure 230 one or more times. Interconnects between the ends of such a wound antenna (e.g., the antenna leads) can connect to the controller 250 in the structure 230. In some examples, the loop antenna can include a plurality of conductive loops spaced apart from each other, such as three conductive loops, five conductive loops, nine conductive loops, etc., positioned within an inner diameter and an outer diameter. With such an arrangement, the polymeric material 220 may extend between adjacent conductive loops in the plurality of conductive loops. Further, the loop antenna 270 may be interconnected to one or more sensor chip positioned within the inner diameter and outer diameter of the loop antenna 270 as described below at block 304 of method 300 shown in FIG. 3, and as shown in FIG. 4C.

Figure 2C:
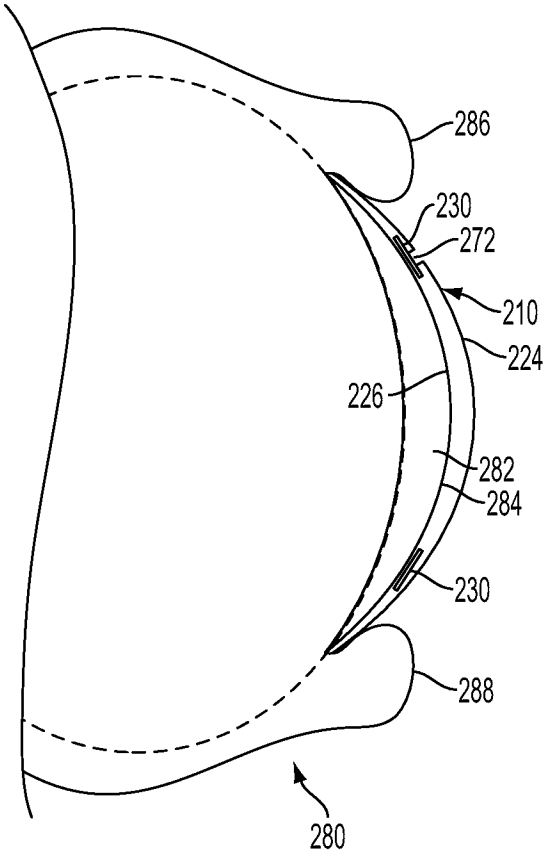
FIG. 2C is a side cross-section view of the eye-mountable device of FIG. 2A while mounted to a corneal surface of the eye, in accordance with an example embodiment.

FIG. 2C is a side cross-section view of the eye-mountable electronic device 210 mounted to a corneal surface 284 of an eye 280. FIG. 2D is an enlarged partial view of the cross-section of the eye-mountable device shown in FIG. 2C. It is noted that relative dimensions in FIGS. 2C and 2D are not necessarily to scale, but have been rendered for purposes of explanation only in describing the arrangement of the eye-mountable device 210. Some aspects are exaggerated to allow for illustration and to facilitate explanation.

The eye 280 includes a cornea 282 that is covered by bringing an upper eyelid 286 and a lower eyelid 288 together over the surface of the eye 280. Incident light is received by the eye 280 through the cornea 282, where light is optically directed to light sensing elements of the eye 280 to stimulate visual perception. The motion of the upper and lower eyelids 286, 288 distributes a tear film across the exposed corneal surface 284 of the eye 280. The tear film is an aqueous solution secreted by the lacrimal gland to protect and lubricate the eye 280. When the eye-mountable device 210 is mounted in the eye 280, the tear film coats both the convex and concave surfaces 224, 226, providing an inner layer 290 (along the concave surface 226) and an outer layer 292 (along the convex surface 224). The inner layer 290 on the corneal surface 284 also facilitates mounting the eye-mountable device 210 by capillary forces between the concave surface 226 and the corneal surface 284. In some examples, the eye-mountable device 210 can also be held over the eye 280 in part by vacuum forces against the corneal surface 284 due to the curvature of the concave surface 226. The tear film layers 290, 292 may be about 10 micrometers in thickness and together account for about 10 microliters of fluid.

The tear film is in contact with the blood supply through capillaries in the structure of the eye and includes many biomarkers found in blood that are analyzed to diagnose health states of an individual. For example, tear film includes glucose, calcium, sodium, cholesterol, potassium, other biomarkers, etc. The biomarker concentrations in tear film can be systematically different than the corresponding concentrations of the biomarkers in the blood, but a relationship between the two concentration levels can be established to map tear film biomarker concentration values to blood concentration levels. For example, the tear film concentration of glucose can be established (e.g., empirically determined) to be approximately one tenth the corresponding blood glucose concentration. Although another ratio relationship and/or a non-ratio relationship may be used. Thus, measuring tear film analyte concentration levels provides a non-invasive technique for monitoring biomarker levels in comparison to blood sampling techniques performed by lancing a volume of blood to be analyzed outside a person's body.

As shown in the cross-sectional views in FIGS. 2C and 2D, the structure 230 can be inclined so as to be approximately parallel to the adjacent portion of the convex surface 224. As described above, the structure 230 is a flattened ring with an inward-facing surface 232 (closer to the concave surface 226 of the polymeric material 220) and an outward-facing surface 234 (closer to the convex surface 224). The structure 230 can include electronic components and/or patterned conductive materials adjacent to either or both surfaces 232, 234.

As shown in FIG. 2D, the bio-interactive electronics 260, the controller 250, and the conductive interconnect 251 are located between the outward-facing surface 234 and the inward-facing surface 232 such that the bio-interactive electronics 260 are facing the convex surface 224. With this arrangement, the bio-interactive electronics 260 can receive analyte concentrations in the tear film 292 through the channel 272. However, in other examples, the bio-interactive electronics 260 may be mounted on the inward-facing surface 232 of the structure 230 such that the bio-interactive electronics 260 are facing the concave surface 226.

While the body-mountable device has been described as comprising the eye-mountable device 110 and/or the eye-mountable device 210, the body-mountable device could comprise other mountable devices that are mounted on or in other portions of the human body.

For example, in some examples, the body-mountable device may comprise a tooth-mountable device. In some examples, the tooth-mountable device may take the form of or be similar in form to the eye-mountable device 110 and/or the eye-mountable device 210. For instance, the tooth-mountable device could include a polymeric material that is the same as or similar to any of the polymeric materials described herein and a structure that is the same as or similar to any of the structures described herein. With such an arrangement, the tooth-mountable device may be configured to detect at least one analyte in a fluid (e.g., saliva) of a user wearing the tooth-mountable device.

Moreover, in some examples, the body-mountable device may comprise a skin-mountable device. In some examples, the skin-mountable device may take the form of or be similar in form to the eye-mountable device 110 and/or the eye-mountable device 210. For instance, the skin-mountable device could include a polymeric material that is the same as or similar to any of the polymeric materials described herein and a structure that is the same as or similar to any of the structures described herein. With such an arrangement, the skin-mountable device may be configured to detect at least one analyte in a fluid (e.g., perspiration, blood, etc.) of a user wearing the skin-mountable device.

Further, some examples may include privacy controls which may be automatically implemented or controlled by the wearer of a body-mountable device. For example, where a wearer's collected physiological parameter data and health state data are uploaded to a cloud computing network for trend analysis by a clinician, the data may be treated in one or more ways before it is stored or used, so that personally identifiable information is removed. For example, a user's identity may be treated so that no personally identifiable information can be determined for the user, or a user's geographic location may be generalized where location information is obtained (such as to a city, ZIP code, or state level), so that a particular location of a user cannot be determined.

Additionally or alternatively, wearers of a body-mountable device may be provided with an opportunity to control whether or how the device collects information about the wearer (e.g., information about a user's medical history, social actions or activities, profession, a user's preferences, or a user's current location), or to control how such information may be used. Thus, the wearer may have control over how information is collected about him or her and used by a clinician or physician or other user of the data. For example, a wearer may elect that data, such as health state and physiological parameters, collected from his or her device may only be used for generating an individual baseline and recommendations in response to collection and comparison of his or her own data and may not be used in generating a population baseline or for use in population correlation studies.

III. EXAMPLE METHODS

A bio-compatible device, such as the eye-mountable device described with respect to FIGS. 1A-2D, may include one or more wireless devices. An example wireless electromechanical device may include a sensor, an antenna, an application specific integrated circuit (ASIC), a battery, an LED, etc. Semiconductor manufacturing techniques can be used to make such a device but there are limitations in reducing the cost when the device includes an antenna to be fabricated on the same substrate as other components (sensors, ASIC, battery, LED, etc.). Disclosed herein is an example manufacturing method to reduce cost of making such a wireless device.

Figure 3:
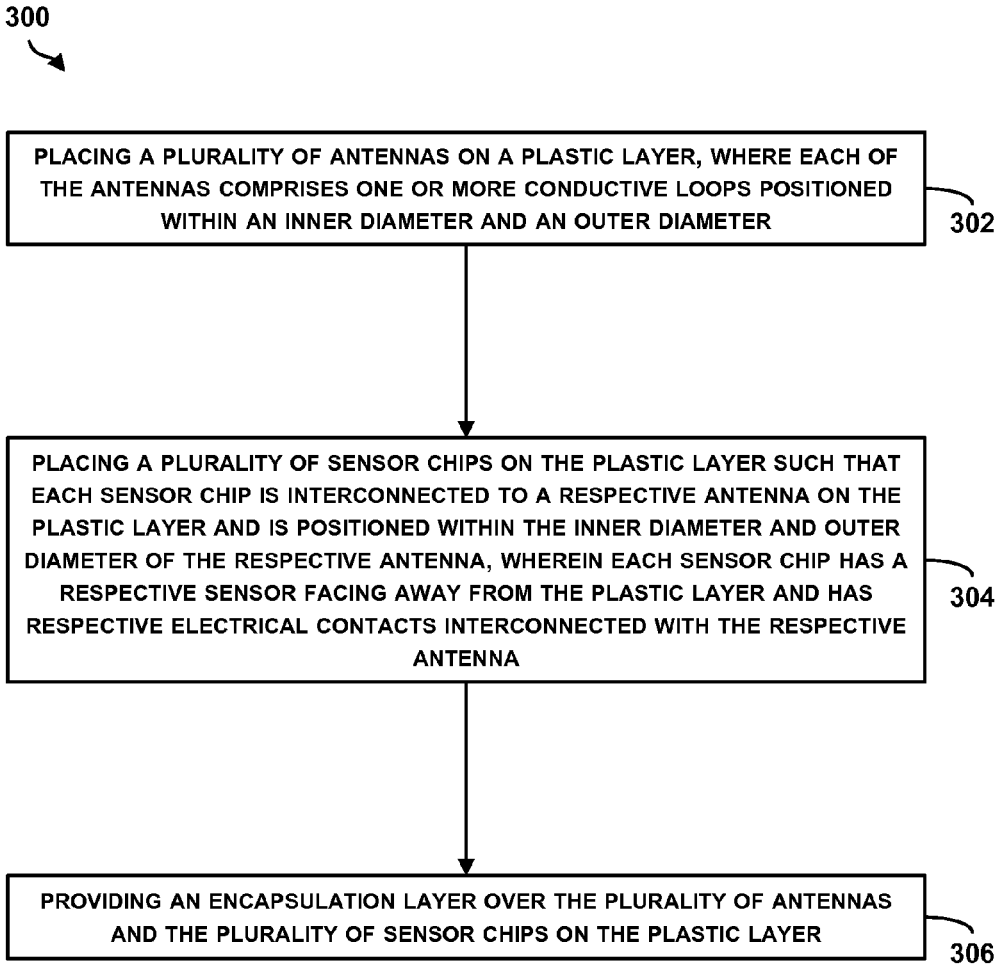
FIG. 3 is a flow chart of a method, in accordance with an example embodiment.

FIG. 3 is a flow chart of a manufacturing method 300 for wireless electromechanical devices, in accordance with an example embodiment. The method 300 may include one or more operations, functions, or actions as illustrated by one or more of blocks 302-306. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 302, the method 300 includes placing a plurality of antennas on a plastic layer, where each of the antennas comprises one or more conductive loops positioned within an inner diameter and an outer diameter. An example antenna (e.g., the loop antenna 270 illustrated in FIG. 2A) could be made of aluminum, silver, gold, copper, printed conductive ink, carbon nanoparticle matrix, or any combination of these materials. As an example, the antenna may include a layer of copper having a thickness of 8 micrometers (μm) coated with another layer of silver or gold. As another example, the antenna may include a layer of aluminum having a thickness of 15 μm coated with another layer of silver or gold. These thickness and materials are examples for illustration only, and other thickness and materials are contemplated.

The antenna could be etched, electroplated, screen printed, inkjet printed, along with other various methods.

In an example, the antenna may include a layer of conductive material patterned along a flat surface of a structure, such as the structure 230, to form a flat conductive ring. The antenna can include a plurality of conductive loops spaced apart from each other, such as three conductive loops, five conductive loops, nine conductive loops, etc., positioned within an inner diameter and an outer diameter.

Figure 4A:
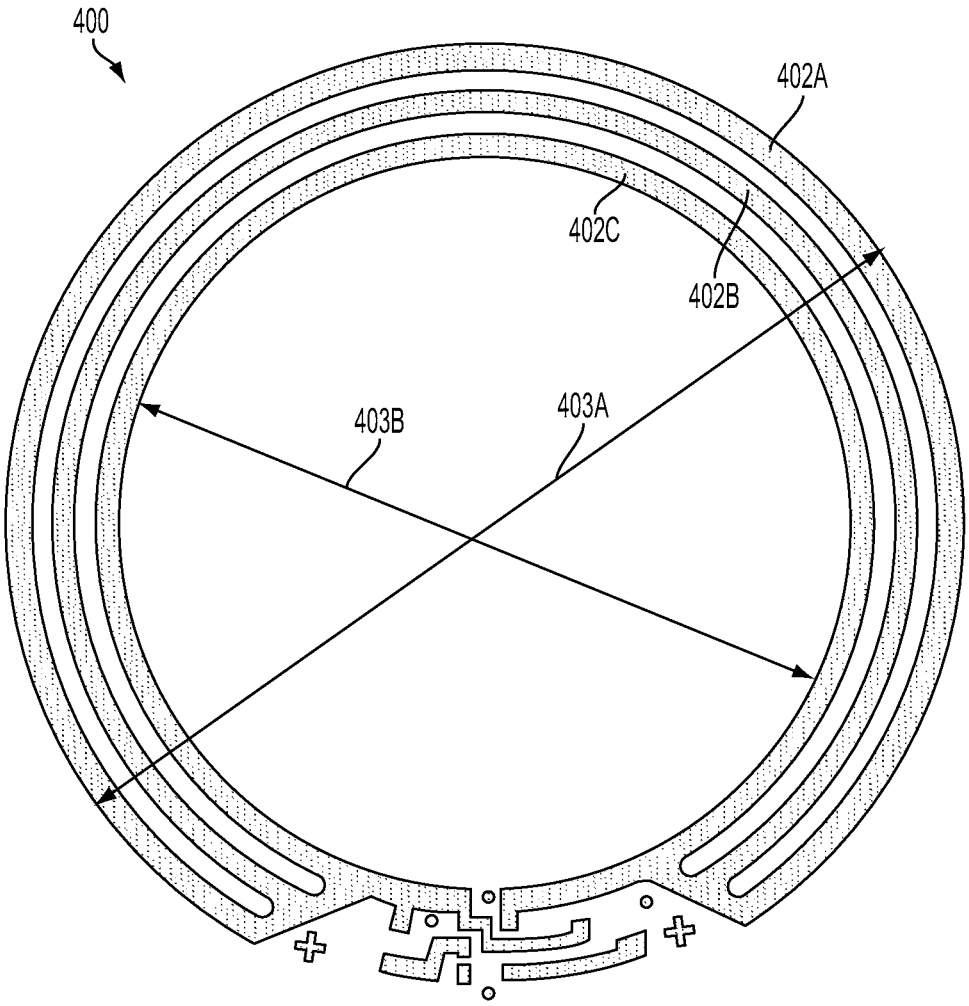
FIG. 4A illustrates an antenna, in accordance with an example embodiment.

FIG. 4A illustrates an antenna 400, in accordance with an example embodiment. The antenna 400 includes three conductive loops 402A, 402B, and 402C. The three conductive loops 402A, 402B, and 402C are positioned within an outer diameter 403A (or outer circumference) of the conductive loop 402A and an inner diameter 403B (or inner circumference) of the conductive loop 402C. Three loops are used herein as an example for illustration only, and any other number of loops could be used. Each antenna can be manufactured separately and placed on a plastic layer.

In an example, as shown in FIG. 4A, the conductive loops 402A, 402B, and 402C are substantially concentric. The term "substantially concentric," as used in this disclosure, refers to exactly concentric and/or one or more deviations that are within a threshold value from exactly concentric. In an example, the conductive loops 402A, 402B, and 402C can be spaced apart by a distance between 100 to 200 μm. Other distances are possible as well. In some examples, the distance between two adjacent conductive loops can vary based on a rotational orientation of one conductive loop relative to an adjacent conductive loop. In some examples, thicknesses of the conductive loops 402A, 402B, and 402C and spacing between the conductive loops 402A, 402B, and 402C may be substantially uniform. The term "substantially uniform," as used in this disclosure, refers to exactly uniform and/or one or more deviations from exactly uniform. In other examples, thicknesses of the conductive loops 402A, 402B, and 402C and spacing between the conductive loops 402A, 402B, and 402C may be non-uniform.

As an example, resistance between two adjacent conductive loops can be greater than 10 Giga Ohm.

In some examples, the conductive loops 402A, 402B, and 402C can have a width of 333 μm. Other widths of the conductive loops 402A, 402B, and 402C are possible as well. Moreover, in some examples, the conductive loops 402A, 402B, and 402C can each have the same width (e.g., the conductive loops 402A, 402B, and 402C can each have a width of 333 micrometers). However, in other examples, the conductive loops 402A, 402B, and 402C might have different widths.

Figure 4B:
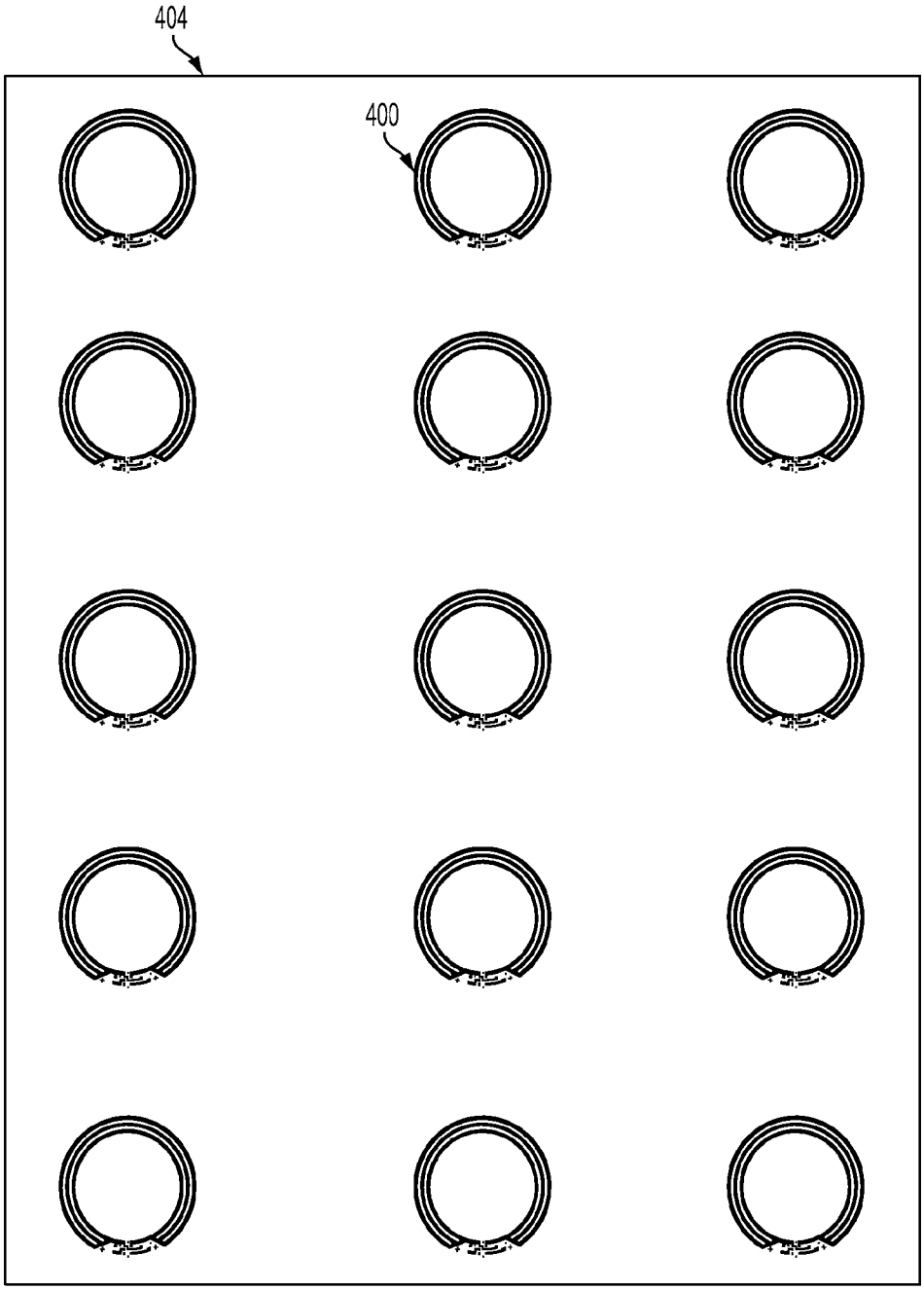
FIG. 4B illustrates a plurality of antennas placed on a plastic layer, in accordance with an example embodiment.
Figure 4C:
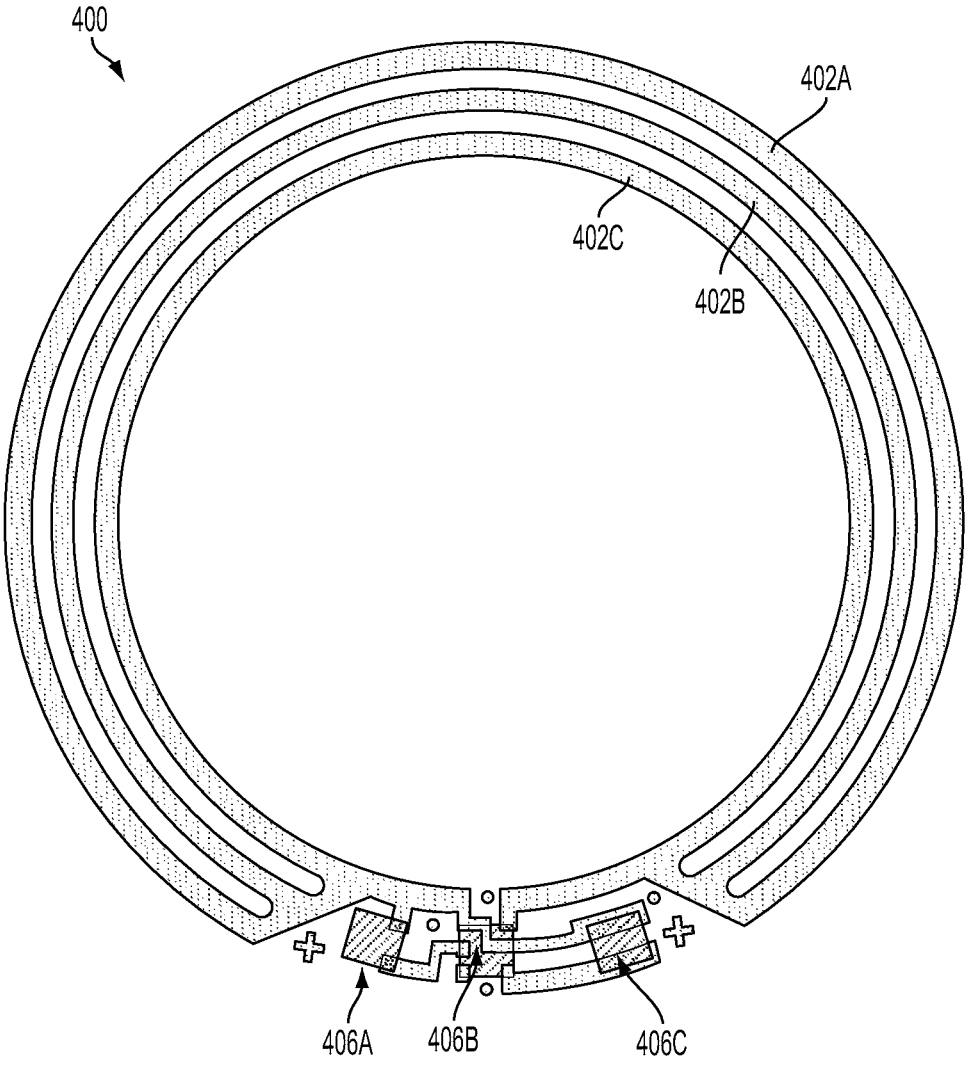
FIG. 4C illustrates an antenna with chips interconnected thereto, in accordance with an example embodiment.

FIG. 4B illustrates a plurality of antennas placed on a plastic layer 404, in accordance with an example embodiment. The plastic layer (or substrate) 404 may be made of, for example, polyester, PET, polyimide, or any other type of plastic. The plastic layer 404 may be a flexible layer that acts as a moisture barrier. An example thickness of the plastic layer 404 may be 25 μm. However, other thicknesses are also possible based on an application in which the wireless electromechanical device may be used in.

Referring back to FIG. 3, at block 304, the method 300 includes placing a plurality of sensor chips on the plastic layer such that each sensor chip is interconnected to a respective antenna on the plastic layer and is positioned within the inner diameter and outer diameter of the respective antenna. Each sensor chip has a respective sensor facing away from the plastic layer and has respective electrical contacts interconnected with the respective antenna.

In some examples, one or more of the conductive loops 402A, 402B, and 402C may not form a complete loop. For example, the conductive loops 402A, 402B, and 402C may include cutouts to allow room for a controller, sensor chips, or any type of electronics to be interconnected with the antenna 400.

FIG. 4C illustrates the antenna 400 with chips 406A, 406B, and 406C interconnected thereto, in accordance with an example embodiment. One or more of chips 406A, 406B, and 406C may be a sensor chip that includes a sensor. The sensor is configured to sense some aspect of its environment, such as an analyte (e.g., glucose in tear film), temperature, pressure, ambient light, etc. As an example, the sensor may be a light sensor integrated into any of the eye-mountable devices described in FIGS. 1-2D, and can detect when a wearer or user blinks or where the wearer is looking, etc. In another example, the sensor is an electrochemical sensor that includes a working electrode and reference electrode. Further, while one of the chips (e.g., chip 406A) may be a sensor chip, the other chips may serve other functions, such as a controller, memory, communications interface, etc. (for purposes of illustration, chips 406A, 406B, and 406C may be referred to herein as sensor chips). In addition, although FIG. 4C illustrates antenna 400 connected to three chips, it is to be understood that the antenna could be connected to a greater or fewer number of chips.

As shown in FIG. 4C, the conductive loops 402A, 402B, and 402C form incomplete loops (i.e., span less than 360 degrees) to leave room to the sensor chips 406A, 406B, and 406C to be interconnected to the conductive loops 402A, 402B, and 402C. For example, the sensor chip 406A is interconnected to the conductive loops 402A and 402C; the sensor chip 406B is interconnected to the conductive loops 402A, 402B, and 402C; and the sensor chip 406C is interconnected to the conductive loops 402B and 402C. As an example for illustration, a given sensor chip may have a size or volume of $800\times800\times80\ \mu m^3$.

Each sensor chip, such as the sensor chips 406A, 406B, and 406C, could be made on its own substrate and then assembled to a respective antenna (e.g., the antenna 400) and the plastic layer 404. Manufacturing of some of these chips may involve high temperature processing. However, the chip can be made on its own substrate (e.g., silicon or glass), thinned down and diced in order to be bonded on a flexible substrate, and assembled to the antenna 400 and the plastic layer 404, such that any high temperature processing occurs before assembly on the plastic layer 404. The plastic layer 404 is thus not subjected to high temperatures. In this manner, the method 300 represents a modular manufacturing process where a wide variety of components can be manufactured separately and assembled onto the plastic layer 404.

Thus, sensor chips such as the sensor chips 406A, 406B, and 406C may be assembled and interconnected to respective antennas of the plurality of antennas placed on the plastic layer 404 illustrated in FIG. 4B. In addition to the sensor chips 406A, 406B, and 406C, other electronic components (controllers/microprocessors, ASIC, battery, LED, etc.) can also be assembled an interconnected to the respective antennas.

Referring back to FIG. 3, at block 306, the method 300 includes providing an encapsulation layer over the plurality of antennas and the plurality of sensor chips on the plastic layer. The plurality of antennas and the plurality of sensor chips placed on the plastic layer may be encapsulated by placing an encapsulation material on the plurality of antennas, the plurality of sensor chips, and the plastic layer.

Figure 4D:
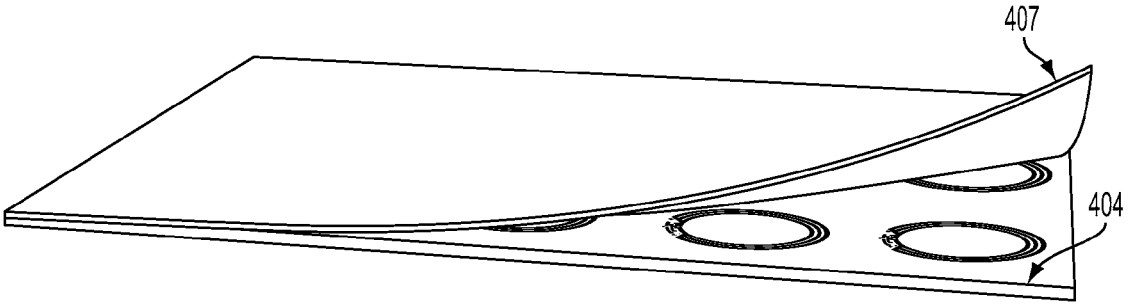
FIG. 4D illustrates application of an encapsulation layer, in accordance with an example embodiment.

FIG. 4D illustrates application of an encapsulation layer, in accordance with an example embodiment. FIG. 4D depicts the plastic layer 404 having placed thereon the plurality of antennas and the plurality of sensor chips. An encapsulation layer 407 is provided on the plurality of antennas, the plurality of sensor chips, and the plastic layer 404. An example thickness of the encapsulation layer 407 may be 25 μm. However, other thicknesses are contemplated.

Figure 4E:
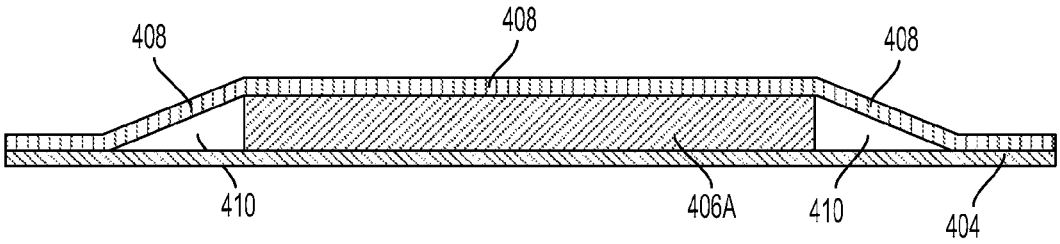
FIG. 4E illustrates an encapsulated structure made using a first method, in accordance with an example embodiment.

FIG. 4E illustrates an encapsulated structure made using a first method, in accordance with an example embodiment. FIG. 4E depicts one of the chips, e.g., the sensor chip 406A placed on the plastic layer 404. The antenna 400 to which the sensor chip 406A is interconnected is not shown in FIG. 4E. In an example, the sensor chip 406A may be flip-chip bonded to the antenna 400 and the plastic layer 404. Any bonding medium, such as anisotropic conductive paste (ACP), anisotropic conductive film (ACF), solder and flux, solder paste, solder followed by underfill, etc., or a flip-chip bonder, may be used to adhere a given sensor chip to a respective antenna. A given sensor coupled to the sensor chip 406A may be facing away from the plastic layer 404A, so as to be exposed to the environment, while contact pads of the given sensor are on the other side of the sensor chip 406A facing the plastic layer 404 and interconnected to the antenna 400.

Different methods may be used to encapsulate the sensor chip 406A. FIG. 4E illustrates a first method that includes placing a laminated sheet overlay or encapsulation layer 408 on the plastic layer 404 and the sensor chip 406A. This method may leave gaps 410 as shown in FIG. 4E.

Figure 4F:
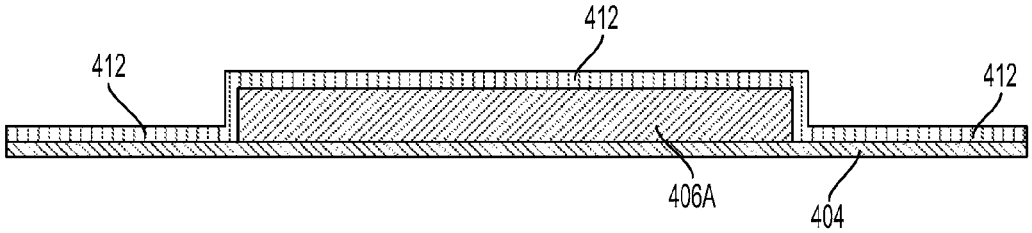
FIG. 4F illustrates an encapsulated structure made using a second method, in accordance with an example embodiment.

FIG. 4F illustrates an encapsulated structure made using a second method, in accordance with an example embodiment. The second method includes applying a liquid or other non-sheet overlay or encapsulation layer 412 on the plastic layer 404 and the sensor chip 406A. The liquid may include, for example, epoxy. In this example, the epoxy may be cured after providing the encapsulation layer 412. As shown in FIG. 4F, using the liquid or other non-sheet overlay to form the encapsulation layer 412 leaves no gaps between the plastic layer 404 or the sensor chip 406A and the encapsulation layer 412.

As described above, a given sensor coupled to the sensor chip 406A may be facing away from the plastic layer 404 so as to be exposed to the environment, while contact pads of the given sensor are on the other side of the sensor chip 406A facing the plastic layer 404 and interconnected to the antenna 400. In one example, the encapsulation layer 408 or 412 may cover the given sensor and then a portion of the encapsulation layer covering the given sensor may be removed to expose the given sensor to the environment.

Figure 4G:
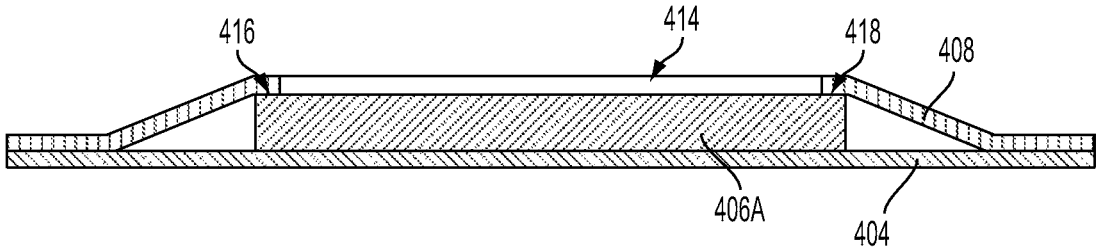
FIG. 4G illustrates an encapsulated structure with an exposed sensor, in accordance with an example embodiment.

FIG. 4G illustrates an encapsulated structure with an exposed sensor, in accordance with an example embodiment. In an example, laser cutting may be used to remove material on top of the sensor chip 406A to expose a sensor associated with the sensor chip 406A to the environment through an opening 414. In examples, a rim of material from the encapsulation layer may be left well-adhered to edges of the sensor chip 406A represented by portions 416 and 418 in FIG. 4G. The encapsulation material may be bonded to the edges of the sensor chip 406A (e.g., bonded to the portions 416 and 418) to provide a waterproof barrier. As an example for illustration the opening 414 may have a diameter of 0.75 mm. However, other hole sizes are contemplated based on a respective size of the underlying sensor chip and associated sensor.

Although FIG. 4G depicts the encapsulated structure illustrated in FIG. 4E, the encapsulated structure illustrated in FIG. 4F could be used as well, and the sensor could be exposed to the environment by similarly making a hole in the encapsulation layer 412.

Laser cutting is used herein as an example for illustration only, and any other cutting/removal technique could be used.

In an example, instead of using laser cutting, holes can be cut into the encapsulating layer 407, which is then aligned to the sensors of the plurality of sensor chips such that the sensors are exposed to the environment.

Instead of forming holes in the encapsulation layer after it has been provided over the antenna and sensor chip, it is possible to use an encapsulation layer that already has holes formed into it. For example, an encapsulation layer may include a plurality of holes corresponding to the plurality of sensor chips placed on the plurality of antennas and the plastic layer. The holes leave the sensors of the sensor chips exposed to the environment. Holes sizes of the encapsulation layer may be such that a rim of material is left adhered to edges of the sensor chips while the respective sensor are exposed to the environment through the holes as described above with respect to FIG. 4G, i.e., the holes in the encapsulation layer are smaller in diameter than a respective diameter of a given sensor chip.

In an example, an encapsulated plastic layer (i.e., the plastic layer 404, the plurality of antennas, the plurality of sensor chips, and the encapsulation layer 407) may be packaged into a roll. For instance, a leading edge of the encapsulated plastic layer may be fed to a take-up roller, which may be configured to rotate at a given speed to wind into a roll. A single roll may thus include a large number of wireless electromechanical devices (each including an antenna and associated chips and components). The roll provides an efficient and cost-effective way of handling a large number of electromechanical devices.

Figure 4H:
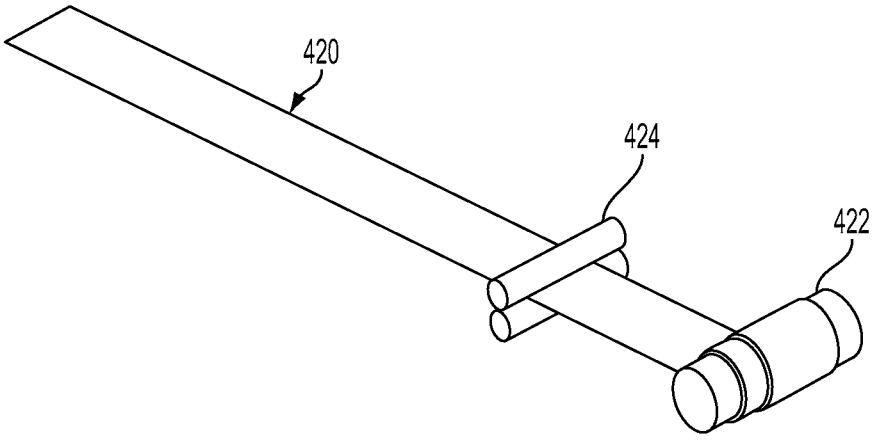
FIG. 4H illustrates feeding an encapsulated plastic layer to a take-up roller, in accordance with an example embodiment.

FIG. 4H illustrates feeding an encapsulated plastic layer 420 to a take-up roller 422, in accordance with an example embodiment. The encapsulated plastic layer 420 has the plurality of antennas and the plurality of sensor chips sandwiched between the encapsulation layer 407 and the plastic layer 404. FIG. 4H depicts the encapsulated plastic layer 420 being fed to the take-up roller 422. The take-up roller 422 may include a core, on which the encapsulated plastic layer 420 is rolled, that is made of an appropriate material. In some examples, the encapsulated plastic layer 420 may be fed through a roll laminator 424 before the encapsulated plastic layer 420 reaches the take-up roller 422. The roll laminator 424 may be configured to rotate at a given rotational speed that matches a respective rotational speed of the take-up roller 422.

In an example, the roll laminator 424 may apply pressure (e.g., 20 psi) to enhance adhesion of the encapsulation layer 407 to the plastic layer 404. Heat may or may not be used in addition to the pressure of the roller laminator 424. Using the roll laminator 424 as a means for applying pressure and/or heat is an example for illustration only, and other techniques can be used to enhance adhesion of the encapsulation layer 407 to the plastic layer 404. In examples, an epoxy layer may be placed between the encapsulation layer 407 and the plastic layer 404 and the components attached thereon to enhance adherence of the encapsulation layer 407 to the antennas, the sensor chips, and the plastic layer 404.

Figure 4I:
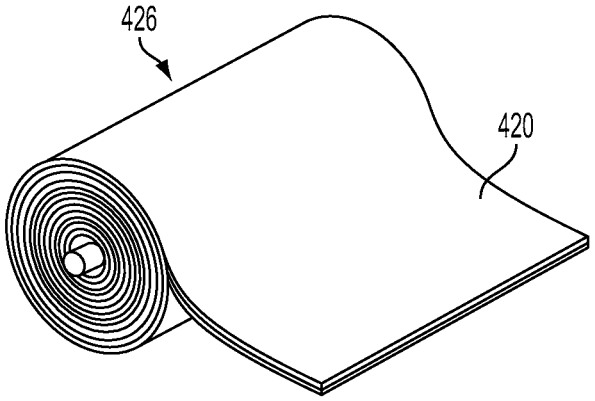
FIG. 4I illustrates a roll, in accordance with an example embodiment.

FIG. 4I illustrates a roll 426, in accordance with an example embodiment. The roll 426 of the encapsulated plastic layer 420 may include a large number of wireless electromechanical devices each having an antenna and associated sensor chips and components. The roll 426 facilitates packaging and handling.

The roll 426 can be unrolled, and individual wireless electromechanical devices can be removed from the plastic substrate for integration into other devices such as the eye-mountable devices described in FIGS. 1A-2D. Laser cutting can be used to separate a single wireless electromechanical device having an antenna and associated sensor chips from the encapsulated plastic layer 420.

Figure 4J:
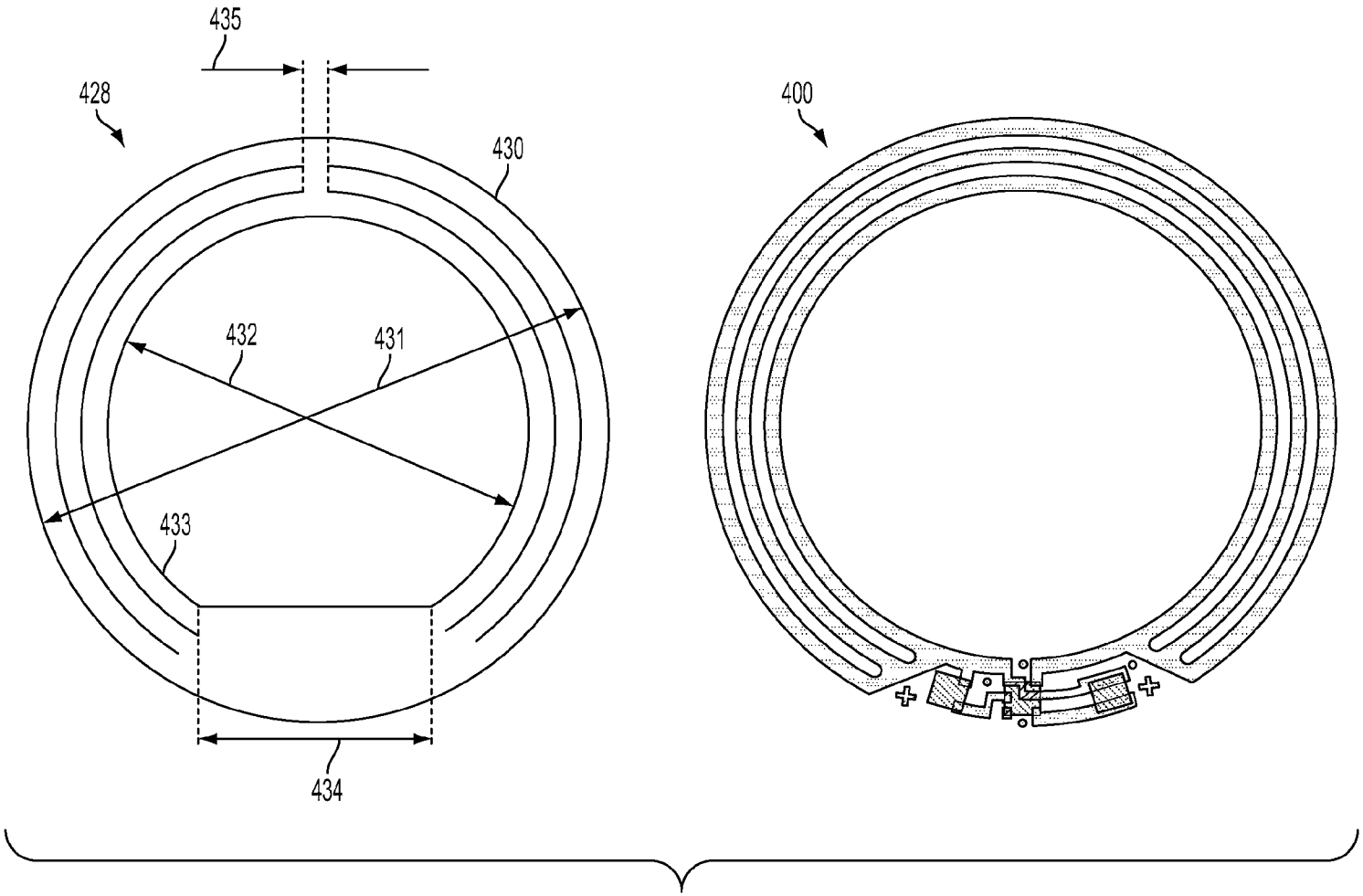
FIG. 4J illustrates laser cutting paths, in accordance with an example embodiment.

FIG. 4J illustrates laser cutting paths 428, in accordance with an example embodiment. FIG. 4J depicts the antenna 400 and the associated sensor chips 406A, 406B, and 406C on the right of FIG. 4J for convenience. Example laser cutting paths 428 that could be traced by a laser cutting machine are shown on the left of FIG. 4J.

As examples for illustration, a thickness of a laser cutting line, such as outer line 430, of the laser cutting paths 428 may be 250 μm or less. A diameter 431 of the outer line 430 may be about 12.5 mm. A diameter 432 of inner line 433 may be about 9 mm. Distance 434 may be about 5 mm and gap 435 may be about 0.6 mm. It should be understood that these dimensions are not limiting and are cited herein as examples for illustration only. These dimensions can vary based on a size of the antenna to be used for a particular application.

Upon tracing the laser cutting paths 428 by the laser cutting machine, a wireless device having the antenna 400 and associated sensor chips 406A, 406B, and 406C is separated from the encapsulated plastic layer 420 and could be integrated into other devices such as the eye-mountable devices described in FIGS. 1A-2D.

IV. CONCLUSION

It should be understood that arrangements described herein are for purposes of example only. As such, those skilled in the art will appreciate that other arrangements and other elements (e.g., machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims, along with the full scope of equivalents to which such claims are entitled. It is also to be understood that the terminology used herein is for the purpose of describing particular embodiments only, and is not intended to be limiting.

Where example embodiments involve information related to a person or a device of a person, some examples may include privacy controls. Such privacy controls may include, at least, anonymization of device identifiers, transparency and user controls, including functionality that would enable users to modify or delete information relating to the user's use of a product.

Further, in situations in where embodiments discussed herein collect personal information about users, or may make use of personal information, the users may be provided with an opportunity to control whether programs or features collect user information (e.g., information about a user's medical history, social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. For example, a user's identity may be treated so that no personally identifiable information can be determined for the user, or a user's geographic location may be generalized where location information is obtained (such as to a city, ZIP code, or state level), so that a particular location of a user cannot be determined. Thus, the user may have control over how information is collected about the user and used by a content server.

What is claimed is:

1. A method comprising:

placing a plurality of loop antennas on a plastic layer, wherein each respective loop antenna of the plurality of loop antennas comprises an inner edge and an outer edge;

placing a plurality of sensor chips on the plastic layer such that each sensor chip is interconnected to the respective loop antenna on the plastic layer and is positioned within the inner edge and the outer edge of the respective loop antenna, wherein each sensor chip has a respective sensor facing away from the plastic layer and has respective electrical contacts interconnected with the respective loop antenna; and providing an encapsulation layer over the plurality of loop antennas and the plurality of sensor chips on the plastic layer.

2. The method of claim 1, wherein the encapsulation layer includes holes over the sensor chips such that the sensors of the sensor chips are exposed through the holes.

3. The method of claim 1, further comprising:

removing a loop antenna and an interconnected sensor chip along with a portion of the plastic layer and a corresponding portion of the encapsulation layer; and exposing a sensor of the associated sensor chip by removing a piece of the encapsulation layer covering the sensor.

4. The method of claim 3, wherein removing the loop antenna and the interconnected sensor chip along with the portion of the plastic layer and the corresponding portion of the encapsulation layer comprises laser cutting.

5. The method of claim 3, wherein removing the piece of the encapsulation layer covering the sensor is performed such that a portion of the encapsulation layer remains on at least an edge of the sensor chip so as to seal the sensor chip against moisture.

6. The method of claim 1, further comprising:

winding the plastic layer having the plurality of loop antennas, the sensor chips, and the encapsulation layer thereon into a roll.

7. The method of claim 1, wherein providing the encapsulation layer over the plurality of loop antennas and the plurality of sensor chips on the plastic layer comprises:

laminating a sheet material over the plurality of loop antennas and the plurality sensor chips on the plastic layer.

8. The method of claim 1, wherein providing the encapsulation layer over the plurality of loop antennas and the plurality of sensor chips on the plastic layer comprises:

applying a liquid material over the plurality of loop antennas and the plurality of sensor chips on the plastic layer.

9. The method of claim 8, wherein the liquid material is an epoxy material.

10. A package comprising:

a plastic layer;

a plurality of loop antennas placed on the plastic layer, wherein each respective loop antenna of the plurality of loop antennas comprises an inner edge and an outer edge;

a plurality of sensor chips placed on the plastic layer such that each sensor chip is interconnected to the respective loop antenna on the plastic layer and is positioned within the inner edge and the outer edge of the respective loop antenna, wherein each sensor chip has a respective sensor facing away from the plastic layer and has respective electrical contacts interconnected with the respective loop antenna; and an encapsulation layer provided over the plurality of loop antennas and the plurality of sensor chips on the plastic layer.

11. The package of claim 10, wherein the encapsulation layer includes holes over the sensor chips such that the sensors of the sensor chips are exposed through the holes.

12. The package of claim 11, wherein a portion of the encapsulation layer remains on at least an edge of the sensor chip so as to seal the sensor chip against moisture.

13. The package of claim 10, wherein the respective loop antenna comprises at least three conductive loops.

14. The package of claim 13, wherein the at least three conductive loops have a substantially uniform spacing between adjacent conductive loops.

15. The package of claim 13, wherein the at least three conductive loops have a substantially uniform thickness.

16. The package of claim 10, wherein the respective loop antenna spans less than 360 degrees so as to provide a space for the plurality of sensor chips to be interconnected to the respective loop antenna.

17. The package of claim 10, wherein the plastic layer having the plurality of loop antennas and the plurality of sensor chips, and the encapsulation layer are wound into a roll.

18. The package of claim 10, wherein the encapsulation layer comprises a lamination sheet provided over the plurality of loop antennas and the plurality sensor chips on the plastic layer.

19. The package of claim 10, wherein the encapsulation layer comprises a cured material provided over the plurality of loop antennas and the plurality of sensor chips on the plastic layer.

20. The package of claim 19, wherein the cured material is an epoxy material.

* * * * *